United States Patent [19]

Fassbind

[11] 4,054,021

[45] Oct. 18, 1977

[54] APPARATUS FOR SIMULTANEOUSLY PACKAGING A SERIES OF ELONGATE BODIES

[76] Inventor: Karl Fassbind, Appisbergstrasse 20, Mannedorf, Switzerland

[21] Appl. No.: 705,584

[22] Filed: July 15, 1976

[30] Foreign Application Priority Data

July 18, 1975 Switzerland ..... 9476/75

[51] Int. Cl.[2] ..... B65B 5/10; B65B 19/34

[52] U.S. Cl. ..... 53/236; 53/148; 53/244; 198/689

[58] Field of Search ..... 53/236, 148, 244, 142; 198/689

[56] References Cited

U.S. PATENT DOCUMENTS 3,185,284 5/1965 Molins ..... 198/689 X 3,543,476 12/1970 Jaroff et al. ..... 53/236 X

*Primary Examiner*—Travis S. McGehee

*Attorney, Agent, or Firm*—O'Brien & Marks

[57] ABSTRACT

An apparatus for simultaneously packaging a series of elongate bodies or articles which are delivered to a packaging location while lying upon an at least approximately horizontal support. A longitudinally movable, endless toothed belt is arranged above the support. The teeth and the tooth gaps of the toothed belt confront the support. The tooth gaps are operatively connected through the agency of openings in the belt with a suction channel in order to suck-up the bodies lying upon the support into the tooth gaps. A stripper mechanism which can be raised and lowered is provided at the packaging location for lowering the series of bodies out of the tooth gaps of the toothed belt into a package located beneath the stripper.

4 Claims, 3 Drawing Figures

APPARATUS FOR SIMULTANEOUSLY PACKAGING A SERIES OF ELONGATE BODIES

BACKGROUND OF THE INVENTION

The present invention relates to a new and improved construction of apparatus for simultaneously packaging a series of elongate bodies or articles —hereinafter simply referred to as bodies— which are infed to a packaging location while lying upon an at least approximately horizontal support.

There is already known to the art a packaging machine wherein the cotton swabs used in the cosmetic industry are packaged in boxes. Each cotton swab possesses an intermediate stick or swab portion, both ends of which have a fiber fleece wound there around. During packaging of such cotton swabs there is conventionally seized a select number of cotton swabs which are arranged in series, in other words lying behind one another, at an infeed location, then the cotton swabs are conveyed horizontally to a location above a box which has been placed in readiness and then vertically downwardly ejected into the box. For each box it is possible, of course, to package a number of layers on top of one another.

With this state-of-the-art packaging machine there is utilized for the horizontal transport of the series of cotton swabs a type of brush which can be pushed from above into the series of cotton swabs, so that these swabs are clamped between the brush teeth or bristles. After horizontal displacement of the thus clamped cotton swabs a stripper is effective, which moves from above downwardly and ejects the cotton swabs clamped in the brush bristles out of the same downwardly into the packaging box which has been placed in packaging position. With this known technique of transferring the infed cotton swabs and delivering such into the positioned packaging box or carton, it is only possible to obtain a maximum delivery capacity of 500 cotton swabs per minute. This limitation exists because the infeeed carriage constructed as a clamping brush, and which must be moved stepwise to-and-fro, would not be able to be accurately employed from above with a downward movement into a series of swabs if there prevailed a greater delivery capacity than 500 swabs per minute, and which infeed would not occur stepwise rather continuously. Consequently, the bristles or teeth of the brush, from time to time, would impact against the continuously delivered cotton swabs during the clamping operation and destroy or damage such swabs.

SUMMARY OF THE INVENTION

Hence, it is a primary object of he present invention to provide a new and improved construction of apparatus for the simultaneous packaging of a series of elongate bodies which is not associated with the aforementioned drawbacks and limitations of the prior art proposals.

Another and more specific object of the present invention aims at the provision of an apparatus of the previously mentioned type which can be improved such that there is attained a greater packaging capacity than 500 swabs per minute.

Still a further significant object of the present invention is directed to the provision of a new and improved construction of apparatus for the simultaneous packaging of a series of elongate bodies or the like, which apparatus is relatively simple in construction and design, extremely reliable and efficient in operation, is capable of packaging the bodies without any appreciable danger of damaging the same, and requires a minimum of servicing and maintenance.

Now in order to implement these and still further objects of the invention, which will become more readily apparent as the description proceeds, the apparatus of this development is manifested by the features that there is provided an endless toothed belt moving lengthwise above the support, the teeth and gaps of the teeth confront the support. The tooth gaps communicate via belt openings or passages with a suction channel for sucking-up the bodies bearing upon the support and into the tooth gaps. An elevationally displaceable stripper is provided at the packaging location for lowering a series of bodies out of the tooth gaps of the toothed belt into a package located beneath the stripper.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Considering now the drawings, it will be understood that an exemplary embodiment of the apparatus for the simultaneous packaging of a series of elongate bodies has been illustrated. With the embodiment under discussion the aforementioned cotton swabs are intended to be packaged into boxes, cartons or the like. Of course, the invention also could be used for packaging other elongate bodies in the same manner, for instance also in boxes or the like.

Figure 1:
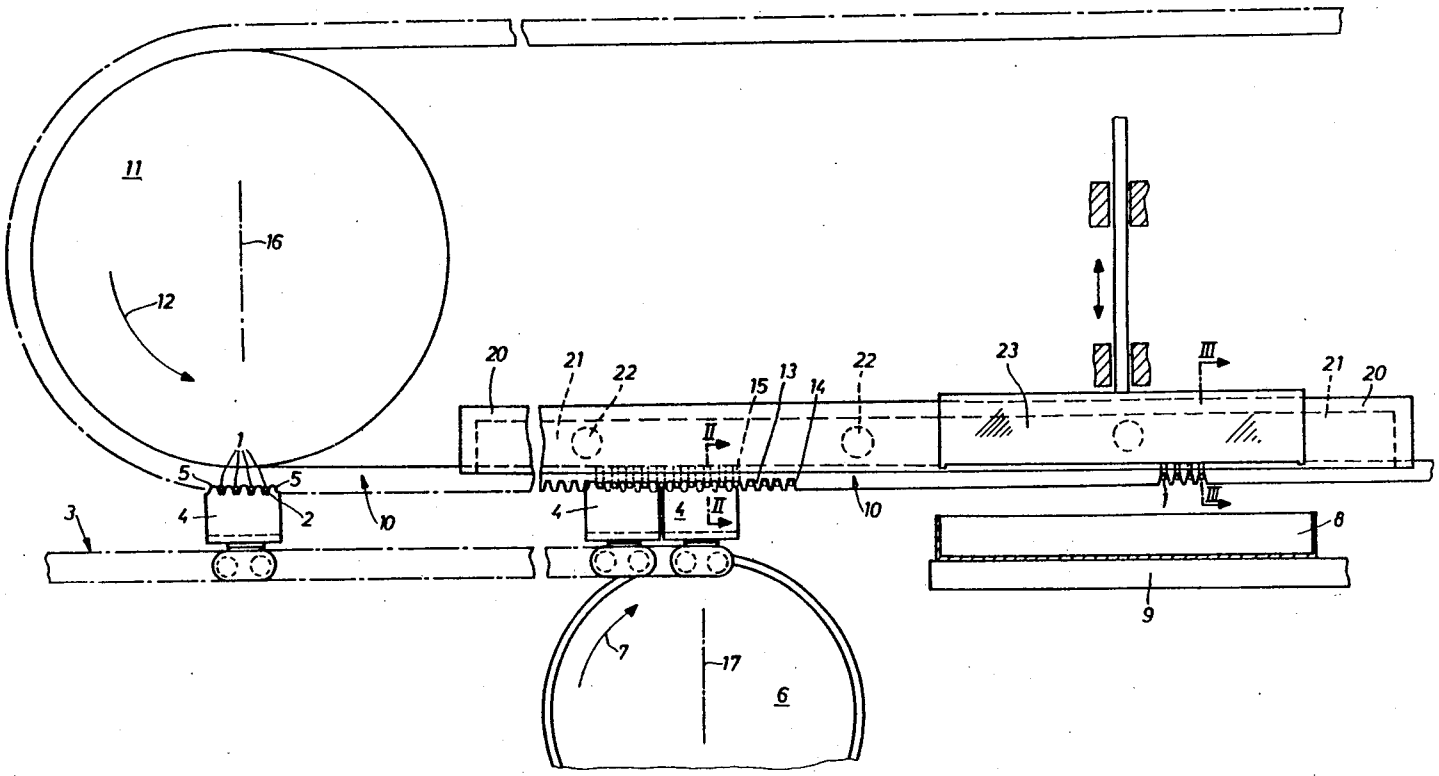
FIG. 1 is a schematic side view of a portion of an apparatus designed according to the present invention.

Turning attention to FIG. 1 the portion of the apparatus illustrated therein will be understood to be arranged at the end of a cotton swab-production machine. At this machine sticks or rods, which have been supplied thereto, are initially provided at both ends with an adhesive and then there is wound thereon a cotton fleece or the like, which thereafter is further treated for fixation purposes, as is well known. The thus fabricated cotton swabs 1 are then located in conventional manner in the tooth gaps 2 of an endless transport chain 3. This transport chain 3 consists of chain links 4, constituting sections of a tooth rack. Each chain link 4 possesses a substantially U-shaped cross-sectional configuration and both of the legs 18, 19 of each such chain link 4 have four aligned tooth gaps 2 and five aligned teeth 5 by way of example. Each cotton swab 1 thus bears in two aligned tooth gaps 2 and is twice supported by a chain link 4, as best seen by referring to FIG. 2. The transport chain 3 travels over the wheels or gears, of which there has only been illustrated the one wheel 6 rotating in the direction of the arrow 7. This above-described mode of transporting the fabricated cotton swabs is part of the state-of-the-art and well known.

In order to package such fabricated cotton swabs the same must be removed from the transport chain 3 and packaged in series in a box or package 8 or equivalent packaging structure. The box or package 8 bears upon a rotatable table 9, the vertical axis of rotation of which is located externally of the showing of the drawing of FIG. 1. The box 8 can receive a number of series or groups of cotton swabs which bear upon one another. When the box 8 has been filled, then, the rotatable table 9 is further rotated through a predetermined angle until another empty box now is in a position preparatory for filling. Hence, the rotatable table 9 is rotatably indexed. Here also it is mentioned that such type arrangement of the boxes 8 upon a rotatable table 9 is known and does not constitute subject matter of the invention.

There will be now hereinafter explained an improved manner of transferring the cotton swabs 1 from the transport chain 3 to the box 8. To this end there is provided an endless toothed belt 10 above the transport chain 3. This toothed belt 10 travels over two wheels or gears, of which only the one wheel 11 has been illustrated, this wheel rotating in the direction of the arrow 12. The upper run of the transport chain 3 and the lower run of the toothed belt 10 thus move in the same direction, specifically in FIG. 1 from the left towards the right. The toothed belt 10 has teeth 13 and tooth gaps 14 as well as a multiplicity of belt openings or passages 15 along the belt itself. Each opening 15 opens into a toothgap 14. The tooth division of the teeth 5 of the transport chain 3 is the same as the tooth division of the teeth 13 of the toothed belt 10, so that the teeth of the transport chain and the toothed belt could mesh with one another. The teeth 13 of the lower run of the tooth belt 10 confront the teeth 5 of the upper run of the transport chain 3.

Figure 2:
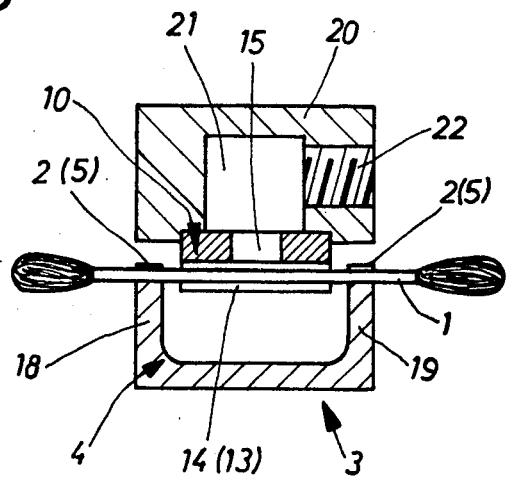
FIG. 2 is a cross-sectional view of the apparatus of FIG. 1 taken substantially along the line II — II thereof.

The toothed belt 10 and the transport chain 3 travel together approximately from the vertical line 16 shown in FIG. 1 to the vertical line 17 such that the tooth belt 10 is located within both legs 18 and 19 of the gear rack-chain links 4 (FIG. 2). Further, the aligned tooth gaps 2 of the chain links 4 align with the tooth gaps 14 of the toothed belt 10. This condition prevails throughout the entire region located between both of the vertical lines 16 and 17, since the toothed belt 10 and the transport chain 3 have the same speed at the region of their teeth 13 and 5. In other words: there does not exist any relative movement between the lengthwise moved toothed belt and the lengthwise transport chain.

Above the lower run of the toothed belt 10 of FIG. 1 there is located a housing 20 containing a suction channel 21 or equivalent structure. In the showing of FIG. 1 this suction channel 21 extends towards the right past the box 8. The housing 20 is provided with a number of threaded connections 22 serving to connect not particularly illustrated suction lines or conduits which lead to an equally not illustrated but conventional suction pump. By means of the just-mentioned suction pump there is maintained a negative pressure in the suction channel 21. Thus, when the cotton swabs delivered by the transport chain 3 enter the tooth gaps 14 of the toothed belt 10 at the region of the vertical line 16 (also see FIG. 2) and the thus mounted cotton swabs then arrive at the region of the suction channel 21, the cotton swabs will be held by the suction force in the tooth gaps 14 of the toothed belt 10. This is also the case if the chain links 4 of the transport chain 3 are deflected by the wheels 6 at the region of the vertical line 17.

The lower run of the toothed belt 10 which moves linearly further towards the right, now carries in a suspended manner the cotton swabs 1 to a location over the box 8. The cotton swabs hanging in the tooth gaps 14 of the toothed belt 10 are counted into a group or series by conventional and therefore not particularly illustrated means, for instanct photocells, and such series of swabs is then displaced by an elevationally movable stripper or stripper means 23, during its downward movement, into the box 8 situated therebelow.

Figure 3:
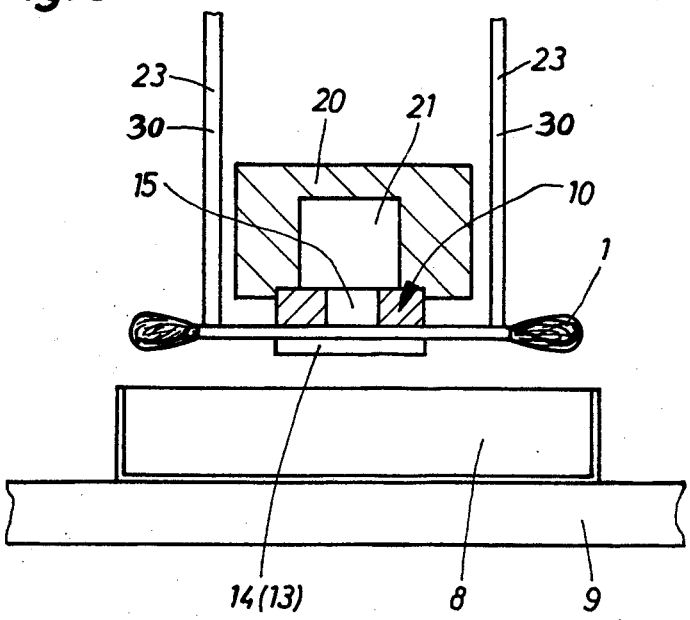
FIG. 3 is a cross-sectional view of the apparatus of FIG. 1 taken substantially along the line III — III thereof.

From the showing of FIG. 3 it will be apparent that the stripper 23 possesss two side walls or cheeks 30 which press against both ends of each associated cotton swab 1. As soon as each cotton swab 1 has been moved downwardly by the stripper 23 a sufficient distance from the suction channel 21 then they can move downwardly in free fall. The downward movement of the stripper 23 is chosen such that it moves more rapidly downward than the cotton swab 1 move downwards in free fall so that thereby the cotton swabs are always pushed by the stripper 23. Due to this measure all of the cotton swabs of a group or series arrive in an orderly arangement adjacent one another in the form of a layer in the box or package 8. There then follows the deposition of the next layer of cotton swabs and so forth.

It has been found that in this manner it is possible to package the cotton swabs in a considerably higher box or package, without disturbing the orderly arrangement of the layer of cotton swabs during their downwardly movement into the box. Thus, successful tests have been carried out wherein the elevational difference between the cotton swabs located at the toothed belt and the floor of a packaging box amounted to 8 cm.

With the disclosed apparatus it is readily possible to achieve a packaging efficiency of 1200 swabs per minute. This is predicated upon a number of advantageous factors. On the one hand, the cotton swabs infed by the transport chain 3 are continuously taken-over by the toothed belt. This is already advantageous in contrast to the prior at stepwise transfer by means of the previously discussed clamping brush. A further advantage resides in the fact that with such transfer the cotton swabs are no longer supported in a suspended manner by a clamping action, rather now by the action of a suction force. Consequently, the danger that the clamping brush bristles during the clamping operation will impact against the cotton swabs and damage the same is avoided. Now since the cotton swabs, during their suspended transport, are no longer clamped there is further present an advantage during downward movement of the cotton swabs into the packaging boxes which are positioned for packaging the swabs. The clamped cotton swabs display the tendancy, when released from the clamping action, of suddenly leaving their clamped position. This snap-like release action of the cotton swabs from the clamping arrangement as prevails in the prior art constructions is associated with the drawback that the cotton swabs will arive in the box in an unorderly position. On the other hand, this danger is effectively precluded by the prevailing suction force. If the cotton swabs are moved downwardly by the stripper 23, then the suction action exerted at the cotton swabs increasingly becomes less, but never stops in a sudden-like manner. The suction force in fact could be chosen to be so large that the cotton swabs which are moved downwardly by the stripper 23 never freely fall, rather the gravitational force exerted thereon is always overcome by the upwardly acting suction force. However, the suction force can also be somewhat less, so that the cotton swabs, during their movement downwardly into the box, move at a lesser speed than during free fall.

While there are shown and described present preferred embodiments of the invention, it is to be distinctly understood that the invention is not limited thereto, but may be otherwise variously embodied and practiced within the scope of the following claims.

Accordingly, what is claimed is:

1. An apparatus for simultaneously packaging a series of elongate bodies, comprising in combination, means defining a packaging station, approximately horizontal support means which bear the bodies for delivering the same to the packaging station, a lengthwise movable, endless toothed belt arranged above the support means, said toothed belt possessing teeth and intermediate thereof tooth gaps, said teeth and tooth gaps confronting said support means, suction channel means, disposed for maintaining a continuous suction, said toothed belt being provided with openings for communicating the tooth gaps with the suction channel means in order to suck-up bodies bearing upon the support means and for placing the same into said tooth gaps, an elevationally displaceable stripper means provided at the packaging station for lowering a series of bodies out of the suction-held tooth gaps of the toothed belt into a package located beneath the stripper means, and wherein said support means comprises an endless lengthwise movable transport chain, said transport chain comprising chain links constituting sections of a gear rack, said chain links having teeth and therebetween tooth gaps which confront the toothed belt, the tooth gaps of the transport chain serving to receive the elongate bodies.

2. The apparatus as defined in claim 1, wherein each of the chain links possesses a substantially U-shaped cross-sectional configuration and includes a pair of spaced legs, said pair of spaced legs of a chain link possessing aligned teeth and tooth gaps to provide a double-fold support of each elongate body arranged in two aligned tooth gaps.

3. The apparatus as defined in claim 1, wherein the division of the teeth of the transport chain and the teeth of the toothed belt are the same.

4. The apparatus as defined in claim 2, wherein the toothed belt is located at least over part of the length of the suction channel within both of the legs of the gear rack- chain links, and the aligned tooth gaps of the chain links are in alignment with the tooth gaps of the toothed belt, so that at this location each elongate body is located in two toothed gaps of the transport chain and in one tooth gap of the toothed belt, and there does not exist any relative lengthwise movement between the lengthwise moved toothed belt and the lengthwise moved transport chain.

* * * * *